US006991555B2

(12) United States Patent
Reese

(10) Patent No.: US 6,991,555 B2
(45) Date of Patent: Jan. 31, 2006

(54) FRAME DESIGN PUTTER HEAD WITH REAR MOUNTED SHAFT

(76) Inventor: John Sanders Reese, 2045 SE. 33rd St., Ocala, FL (US) 34471

( * ) Notice: Subject to any disclaimer, the term of this patent is extended or adjusted under 35 U.S.C. 154(b) by 71 days.

(21) Appl. No.: 10/867,001

(22) Filed: Jun. 14, 2004

(65) Prior Publication Data

US 2005/0003902 A1 Jan. 6, 2005

Related U.S. Application Data

(60) Provisional application No. 60/479,044, filed on Jun. 17, 2003.

(51) Int. Cl.
*A63B 53/06* (2006.01)
*A63B 69/36* (2006.01)

(52) U.S. Cl. ..... 473/251; 473/313; 473/340; 473/334; 473/288

(58) Field of Classification Search ..... 473/324–350, 473/287–293, 251–256, 219; D21/736–746
See application file for complete search history.

(56) References Cited

U.S. PATENT DOCUMENTS 2,222,534 A * 11/1940 Harris ..... 473/248
3,873,094 A * 3/1975 Sebo et al. ..... 473/250
4,010,958 A * 3/1977 Long ..... 473/341
4,253,667 A * 3/1981 Clark et al. ..... 473/325
4,754,976 A * 7/1988 Pelz ..... 473/340
4,815,739 A * 3/1989 Donica ..... 473/313
4,871,174 A * 10/1989 Kobayashi ..... 473/252
5,080,365 A * 1/1992 Winchell ..... 473/255
5,275,412 A * 1/1994 Innes ..... 473/253
5,470,070 A * 11/1995 Bendo ..... 473/252
5,529,302 A * 6/1996 Rodriguez ..... 473/251
5,580,058 A * 12/1996 Coughlin ..... 273/250
5,628,694 A * 5/1997 O'Connor ..... 473/157
5,827,130 A * 10/1998 Jimenez et al. ..... 473/313
5,993,324 A * 11/1999 Gammil ..... 473/251

* cited by examiner

*Primary Examiner*—Sebastiano Passaniti

(57) ABSTRACT

A golf putter head design comprising a front face (10) and a back weight (20) sandwiching multiple longitudinal rods (14, 16) and with a center shaft mounting rod (18) attached to the back weight (20) to form a frame design where the vertical gaps in the putter head are spaced the width of the golf ball to facilitate alignment at setup and the shaft mounting rod (18) is spaced back from the face (10) to form an additional alignment and stroke aiding sight area. The putter head design takes advantage of: embodied and relational sight lines; an uncluttered center sight line and sight area; peripheral rods (14, 16) that are hollow to reduce their density such that weight can be optimally located in the back weight (20); a back weight providing a high percentage of the putter head weight significantly behind the face (10) and below the center line of the face (10); an option for a pivotable shaft; an option for interchangeable face (10), connecting rod (14, 16), shaft connecting rod (18) and back weight (20) elements.

6 Claims, 3 Drawing Sheets

FRAME DESIGN PUTTER HEAD WITH REAR MOUNTED SHAFT

CROSS-REFERENCE TO RELATED APPLICATIONS

This application claims the benefit of provisional patent application Ser. No. 60/479,044 Jun. 17, 2003 by the present inventor.

BACKGROUND OF THE INVENTION

1. Field of Invention

This invention relates to golf club putters, specifically to an improved putter head.

2. Prior Art

The putter is the most important club for a golfer. On average, the putter is used on 40% of the strokes taken by a golfer during a round of golf, twice as much as the second most used club, the driver. Most putter heads are manufactured with a rigid appearance, percussion, balance, length, width, height, loft, lie and weight, so the golfer must learn to conform to the putter. There is a need for a putter that conforms to the golfer, a putter that can be customized to fit the golfer's preferences. It is also important that the putter can be manurfactured cost effectively so as to be affordable for the average golfer. A putter head design that is symmetrical and simple in construction will allow for maximum manufacturing efficiency.

In Golf Magazines, May 1995 issue, in the article "How to Pick a Putter", pages 100–101, David T. Pelz lists the most important attributes in choosing a putter—in order by most important: 1)shaft length (putter head design must be able to accomodate the full range of putter shaft lengths from conventional to mid/belly to long to side saddle), 2) shaft angle [lie], 3) balance [peripheral weighting], 4) alignment aides, 5) weight, 6) grip(not relevant to putter head design), 7) head-twisting at impact [torque], 8) repetitive soling (returns to same position when soled), 9) appearance, and 10) feel [percussion/distance control]. In the past year data has been developed to move items 7 and 10 even higher on the list. Back weighted putter heads have been developed to increase moment of intertia such that head twisting at impact is greatly reduced. And, low loft, low weight location putter heads have been developed to maximize putting stroke smoothness and hence distance control.

Golf is a game of accuracy and repeatability of which alignment and distance control play a very significant part. When a golfers use the standard alignment aids on putter heads (lines, circles, etc), many tend to aim right or left of the target. When the golfer performs the putting strike, their brain makes a subconscious correction by either opening or closing the striking face at impact. This is further aggravated by putter head designs that readily twist (torque) if the ball is contacted even slightly off center on the putter face.

As the golfer nears the target, the hole, less correction is used; but, in essence the golfer has a slightly different putting stroke for every distance.

Rarely does a golfer have a putt that is perfectly straight so some curvature must be allowed for on nearly all putts. In order to correctly visualize the proper starting direction for a putt the golfer must decide the speed with which to roll the putt because there will be many different possible correct combinations of speed and direction. The speed relates to going a certain distance and therefore distance control is essential for the golfer to achieve the planed speed on a given putt.

A variety of golf putter designs have been developed to improve putter face alignment and/or improve movement control of a putter face by giving visual feedback to the golfer relative to alignment of the putter face before and during the putting stroke.

Most recent prior art apparatus has incorporated visual aids in an attempt to help the golfer align the putter face on the proper line. These aids have included lines, dots, symbols, circles, discs and other markings.

But these approaches have been to some degree confusing because they introduce either curves or conflicting size items relative to the size of the golf ball and they don't provide any significant assistance in visualizing the actual forward and backward path of the putter head.

Most recent prior art apparatus has mounted the putter shaft either into the putter face itself or into a connecting bar, rod, etc attached directly to the putter face. This has interferred with the golfers ability to clearly see the golf ball and putter face/alignment elements for the purpose of aligning the putter towards the intended starting line for the putt.

Most recent prior art apparatus has also placed a portion of the putter head mass behind the face of the putter in order to improve the pendulum flow of the stroke to keep the putter more on-line during the actual stroke. Also, the moving of some of the mass behind the putter face has been accompanied by also concentrating the mass below the center line of the putter face to improve the roll characteristics of the ball after impact. Finally, the mass has been moved as far back as regulations allow in order to maximize the moment of inertia thereby reducing the tendency of the putter head to twist during the backward and forward stroke, and on off-center hits. Conventional mounting of the putter shaft to the putter head has limited the ability to maximize the above improvements. Prior art has positioned the hands of the golfer even with the club face such that at the point of impact the hands and the ball are in the same basic position. This has required that the hands "release" the putter head at the point of impact to avoid opening or closing the club face and the corresponding misdirection of the ball.

All putter heads have some type of alignment aid. The most common is perpendicular squaring, when an elongated-embodied element extends perpendicular to the longitudinal axis of the putter head, analogous to lining up a tennis ball with a racket. Of those, most use singular squaring, having only one embodied element.

U.S. Pat. No. 2,222,534 to Howard T. Harris (1940) discloses a putter with two plates. Multiple elements are easier to align than one element because the brain can use multiple reference points for aligning the putter head. Even with multiple elements, perpendicular squaring is not as easy to align as parallel squaring, when an elongated-embodied element extends parallel to the longitudinal axis of the putter head, analogous to lining up a billiard ball with a cue.

U.S. Pat. No. 5,529,302 to Moctezuma Rodriguez (1996) discloses a putter head that uses one slender-elongated rod for parallel squaring. the single rod has the benefit of creating a free-standing embodied sight line which is also easier to align than painted lines on a thck element because the golfer can see the turf beside the element and decide how the element should travel over the turf, creating a relational effect. Even though singular parallel squaring improves alignment, it ususally fails to provide peripheral weighting, when a putter's toe and heel areas weigh more than its center. Peripheral weighting is desired because it increases moment of inertia to reduce putter head twisting (torque) on impact with the ball.

U.S. Pat. No. 4,754,976 to David Pelz (1988) discloses a putter head that improves peripheral weighting by using a thick-elongated rectangle. The rectangle is also capped by a plate but the plate is rendered nonexistent by the rectangle's thickness which is thicker than the golf ball and the central focus area. The thickness weakens the embodied sight line and parallel squaring. This is an example where improving peripheral weighting inevitably weakened parallel squaring, creating an ostensibly inverse relationship between the two.

U.S. Pat. No. 3,873,094 to Alexander Sebo and Leroy H. Despins (1975) discloses multiple parallel squaring elements using three elongated cylinders in a transparent plate. Since longer elements are easier to align than shorter elements, the relatively short length of the cylinders, and the position of the hosel between the cylinders, weakens parallel squaring. Additional embodiments of this patent use webs or bridges to conect the short cylinders which further impedes the embodied sight line and weakens parallel squaring.

The next step in the progression is putters that have a least one perpendicular and one parallel squaring element in one design.

U.S. Pat. No. 5,080,365 to Frank J. Winchell (1992) discloses a putter head that uses an elongated rod as the parallel squaring element and an elongated plate as the perpendicular squaring element. The putter head has a plan view silhouette resembling the letter 'T'. This design suffers for the ostensibly inverse relationship between perpheral weighting and parallel squaring. Additional embodiements of this patent address perpheral weighting by changing the shape of the rod into a triangular framework with weighted-knobs at each corner. The change inevitably weakens parallel squaring because it creates non-linear plan view interference from protuberances, cavities and transversing elements.

U.S. Pat. No. 5,470,070 to Christopher J. Bendo (1995) discloses another putter in the shape of a 'T' where the ends of the perpendicular squaring element terminate into nodules. The majority of the putter head is still located in the parallel squaring element. The sinuous body weakens perpendicular and parallel squaring. Again, improving peripheral weighting inevitably weakened parallel squaring.

U.S. Pat. No. 5,580,058 to Brian E. Coughlin (1996) discloses a putter head with one elongated plate for perpendicular squaring and two elongated rods at the peripheries for parallel squaring. The putter head's main objective is to place the rods out of the central focus area, weakening parallel squaring. Again, improving peripheral weighting inevitably weakened parallel squaring.

U.S. Pat. No. 4,253,667 to Jack L. Clark and William T. Naud (1981) discloses a putter head with an elongated rectangular midsection with extending webs that give the putter head a plan view silhouette resembling the letter 'H'. This design also suffers for the ostensibly inverse relationship between peripheral weighting and parallel squaring. Its midsection is too thick to be effective for parallel squaring.

U.S. Pat. No. 5,275,412 to Stuart W. Innes (1994) discloses a putter head with a long front and sole plates and a short back plate. Three tiny rungs bridge the front plate with the back plate to create multiple parallel squaring elements. The tiny size of the rungs weakens the embodied sight lines, and the position of the sole plate beneath the rungs eliminates the relational effect of a free-standing embodied sight line.

U.S. Pat. No. 5,628,694 to O.Connor, Jr. (1997) discloses a practice putter head with a plan view silhouette in the shape of a hollow rectangular-oval. Inside the hollow are three tiny rungs for longitudinal alignment on a rug painted with three corresponding lines. The tiny size of the rungs combined with deltoid ends, and the position of the rungs near the bottom of the deep rectangular-oval, weakens parallel squaring.

Frame design putter heads provide both multiple perpendicular and parallel squaring elements in one design.

U.S. Pat. No. 4,010,958 to Steven K. Long (1997) discloses a frame design putter head where multiple rods are parallel, perpendicular and angled to the longitudinal axis of the putter head. The putter head's primary feature, weighted square knobs at the corners of a square frame, combined with angled and sinuous internal rods, creates interference that weakens both parallel and perpendicular squaring. The center rod is too thin and sinuous, and the gaps between the longitudinal rods, though prototypical of peripheral weighting, are much too large—over twice the width of the longitudinal rods—to be effective for parallel squaring. The lack of a center rod in additional embodiments further widens the gap between rods. Design Pat. No. 231,373 to Richard Pavelle (1974) discloses a frame putter head with five plates. Two lateral plates are used as perpendicular squaring elements, and three longitudinal plates are used as parallel squaring elements. The center longitudinal plate is too thin, and the gaps between the longitudinal plates, though prototypical of peripheral weighting, are much too large—over twice the width of the longitudinal plates—to be effective for parallel squaring. The smooth connections between the plates, and the lack of extending webs, obscures the borders between lateral and longitudinal plates which weakens perpendicular and parallel squaring. This design doesn't provide optimal peripheral weighting since the plates are composed of the same material throughout.

U.S. Pat. No. 5,993,324 to Alex R Gammil (1999) discloses a frame design putter head using plates and rods arranged to provide perpindicular and parallel squaring. However, peripheral weighting is weakened due to the center (front to back) location of the putter shaft which reduces the moment arm for maximizing moment of inertia. This centered location balances the front and back weight such that the stroke must be level, thus preventing improving roll by being able to strike the ball with a slightly rising stroke which only an unbalanced front to back weight ratio can offer. The narrow spacing recommended between the longitudinal rods further limits the achievable peripheral weighting. The same narrow spacing limits using the longitudinal rods for proper putter face and ball alignment during setup. And, in the embodiment with the putter shaft attaching to a center longitudinal rod, the parallel aligment advantage of the rod (like a pool cue) is weakened because the rod attaches to the front plate thereby eliminating the relational effect of a free-standing embodied sight area.

U.S. Pat. No. 5,827,130 to Rafael F. Jimenez and Gregory L. Jimenez (1998) discloses a "tail heavy" putter head design which uses disproportionate weighting in the heel versus the toe of the putter head to counter act twisting tendencies during the putting stroke. This use of the term "tail heavy" is not related to having a significant rearward weight distribution in order to achieve improved roll.

There is still the need for a putter head that optimizes alignment and performance, a putter that can help the golfer setup up correctly and execute the putting stroke correctly with maximum consistency.

BACKGROUND OF THE INVENTION—OBJECTS AND ADVANTAGES

Several objects and advantages of the present invention are:

a) to provide a putter head which optimizes alignment without sacrificing performance;

b) to provide a putter head which optimizes performance without sacrificing alignment;

c) to provide a putter head which optimizes setup ball position without sacrificing alignment or performance;

d) to provide a putter head which optimizes sight lines;

e) to provide a putter head which allows customization for right or left handed, use, lie angle, peripheral weighting, alignment aides, weight, moment of inertia, repetitive soling, appearance, percussion, and loft; and f) to provide an adjustable putter head which is simple to operate.

Other objects and advantages are:

a) to provide a putter head which optimizes the pendulum motion of the putting stroke;

b) to provide a putter head which encourages a straight-back/straight-through putting stroke to eliminate having to release the putter head during the stroke;

c) to provide a putter head which optimizes ball roll;

d) to provide a putter head which maximizes moment of inertia without sacrificing alignment or performance; and, e) to provide a putter head which is simple to manufacture at low cost.

Additional objects and advantages will become apparent from a consideration of the drawings and ensuing descriptions.

SUMMARY

A golf putter head comprising multiple rectilinear longitudinal elements sandwiched between multiple lateral elements, where the gap between the longitudinal elements is approximately the width of the golf ball. And a center longitudinal element only attached to the rear lateral element is located above the plane of the two sandwiched longitudinal elements, that will:

(1) improve alignment by using a center sight line with a relational sight area;

(2) optimize alignment by using embodied and relational sight lines;

(3) optimize setup at address to properly locate ball position;

(4) improve performance by using- a rear lateral element that is significantly greater in density than the rest of the putter head;

(5) improve roll/distance control performance by providing a high percentage of weight distribution to the rear of the shaft attachment point;

(6) improve pendulum stroke performance by providing a high percentage of weight distribution below the center of the forward lateral element;

(7) improve performance by using peripheral longitudinal elements whose density can be selected to optimize desired overall weight; and (8) optimize user customization and manufacturability by using lateral and longitudinal elements that are removable, adjustable or interchangeable.

DRAWINGS—FIGURES

Figure 1:
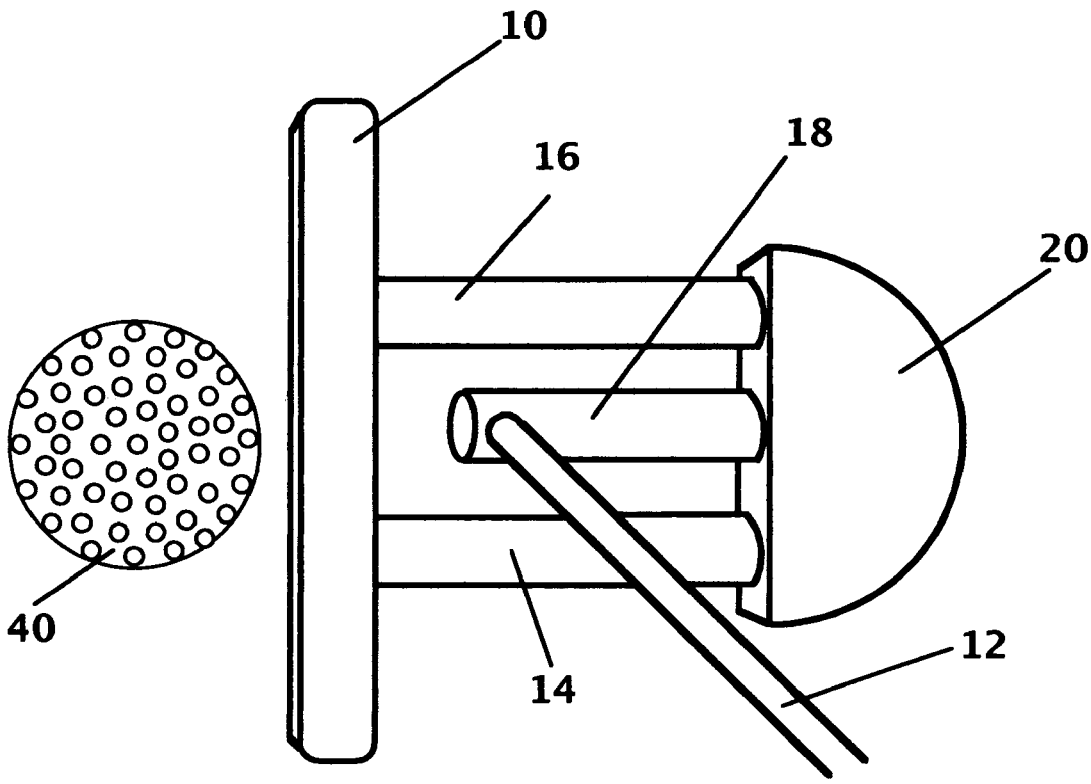
FIG. 1 shows a top perspective view of a typical embodiement of the present invention with a golf ball in the alignment position.

| DRAWINGS—REFERENCE NUMERALS | |
|---|---|
| 10 Face | 12 Putter Shaft |
| 14 Left Connecting Rod | 16 Right Connecting Rod |
| 18 Shaft Mounting Rod | 20 Back Weight |
| 22 Standoff | 24 Standoff Screw |
| 26 Shaft Mounting Rod Screw | 28 Lock Washer |
| 30 Connecting Rod Hole | 32 Shaft Mounting Rod Hole |
| 34 Connecting Rod Screw Hole | |
| 36 Shaft Mounting Rod Screw Hole | |
| 38 Shaft Mounting Hole | |
| 40 Golf Ball | |

DETAILED DESCRIPTION—PREFERRED EMBODIMENT—FIGS. 1 to 4

A typical embodiment of the present invention is illustrated in FIG. 1. The putter head has a forward lateral element or face 10 and a rear lateral element or back weight 20 that sandwich two peripheral rods or connecting rods 14, 16. Additionally, a center rod or shaft mounting rod 18 is attached to the front of the back weight 20. The face 10 is planar in shape, 11.43 cm long, 2.54 cm high and 127 mm thick. The back weight is semi-circular in shape, 6.98 cm long, 2.10 cm high and 3.18 cm deep. The back weight 20 is made of a material heavier than the face 10.

Figure 2:
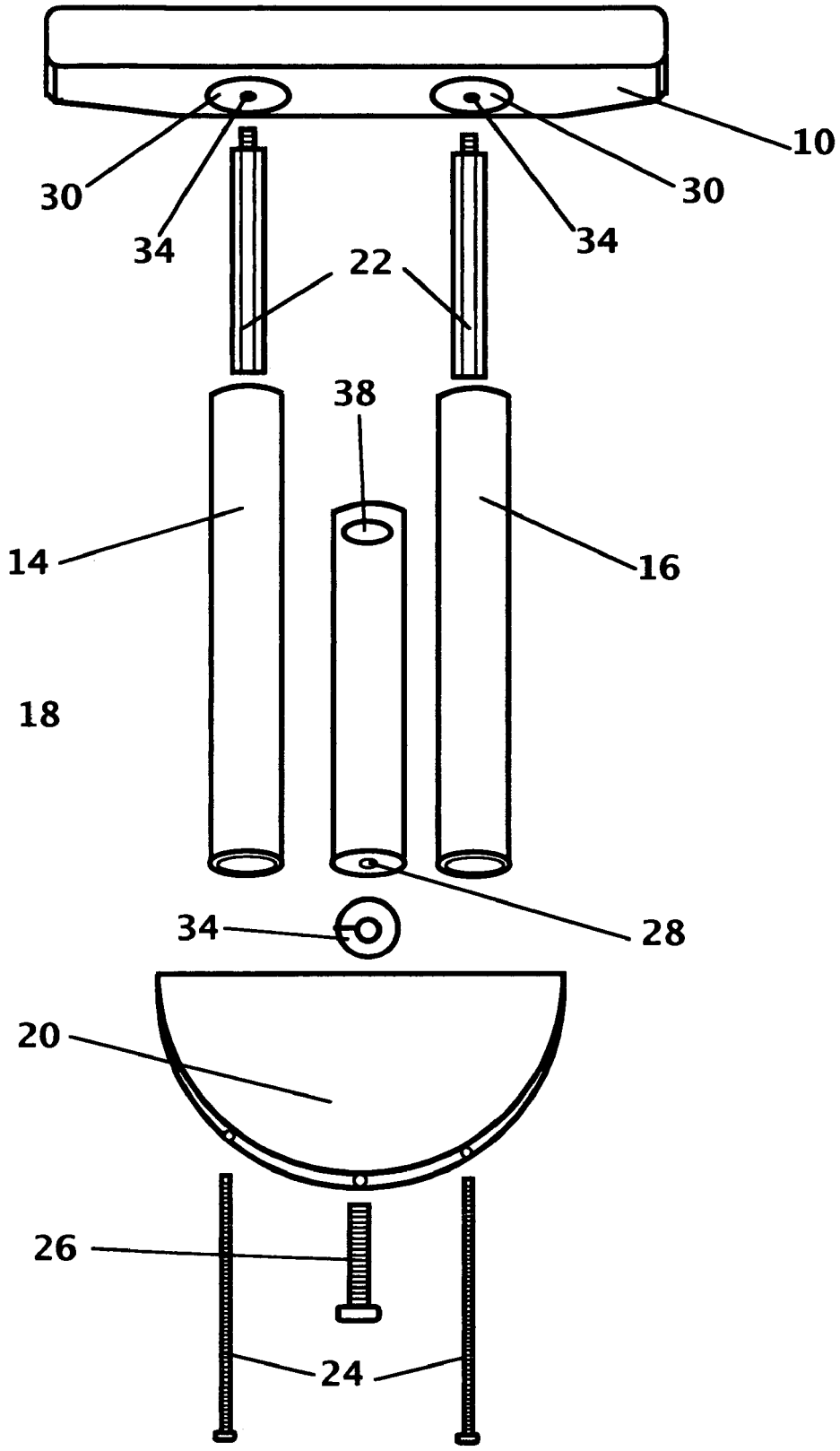
FIG. 2 shows an exploded view of a typical embodiement of the present invention.
Figure 3:
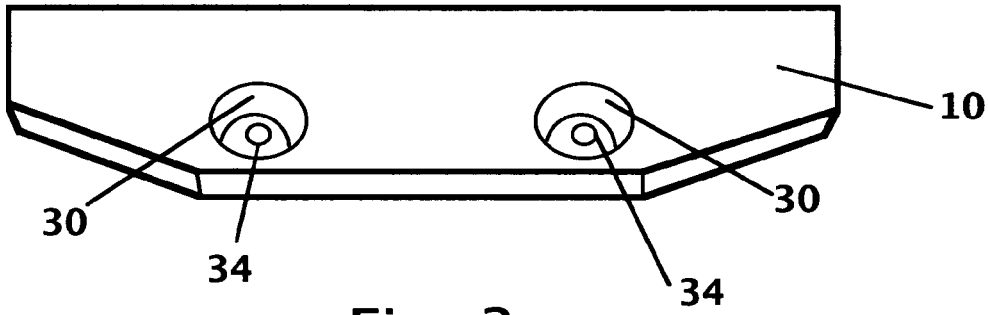
FIG. 3 shows a rear view of a typical forward lateral element.
Figure 4:
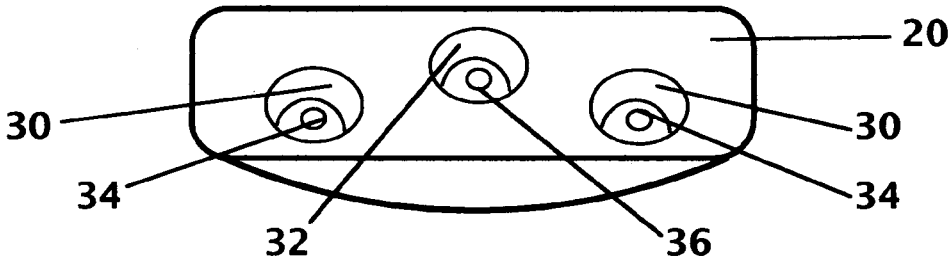
FIG. 4 shows a rear view of a typical rear lateral element.

FIG. 2, an exploded view of a typical embodiment of the present invention shows how the complete putter head is assembled. FIGS. 3, 4 show more detailed views of each of the main elements. The connecting rods 14, 16 are tubes 127 mm in diameter with wall thickness of 21 mm and 8.64 cm long. The centers of the connecting rods 14, 16 are spaced 4.32 cm inches apart (the approximate diameter of the golf ball) and are equidistant from the lateral center of the face 10. The centers of the connecting rod holes 30 are located 88.9 mm above the bottom of the face 10 and back weight 20. The face 10 and back weight 20 are pulled together by two standoffs 22 and a standoff screws 24 running through each connecting rod 14, 16. The shaft mounting rod 18 is 127 mm diameter and 6.60 cm long. The shaft mounting rod 18 is centered laterally in the backweight and its center is located 127 mm above the bottom of the backweight 20. The shaft mounting rod 18 is attached to the backweight 20 in the shaft mounting rod hole 32 using the shaft mounting rod screw 26 and the shaft mounting rod lock washer 28. The putter shaft 12 enters the shaft mounting hole 42 88.9 mm from the forward end of the shaft mounting rod 18 (the end closest to the back of the face 10). Location of the Putter Shaft 12 behind the putter face allows a clear view of the ball for optimum alignment.

The above description is for a putter head for a right handed golfer, but the present invention can be explained equally well for left handed golfers by rotating the shaft mounting rod 18 to the other side of the putter head in the figures.

The left connecting rod 14 and the right connecting rod 16 have a contrasting color with the face 10 to allow a good visual reference for teaching and learning the correct backward and forward swing path of the putter head during the putting stroke.

The back weight 20 can be of a high mass using a high density metal, such as brass or steel or tungsten, in order to maximize the moment of inertia of the complete putter head assembly by maximizing the mass behind the face 10. And, the face 10 can be constructed of a lower density metal such as aluminum to minimize its mass and use different materials for coating and or as an insert to change the feel of impact with the ball.

The left connecting rod 14 and the right connecting rod 16 can be of the greatest length allowed by USGA regulations in order to further maximize the moment of inertia. Higher density metal such as brass, steel or tungsten can also be added in a form such as small discs to the heel and toe of the face 10 to further increase the putter head's moment of inertia and improve its rigidity for improved feel and sound. All such increases in the moment of inertia serve to reduce the tendency for the putter head to twist during the backward or forward stroke or at the moment of an off-center impact with the golf ball.

The weight distribution is kept below the center line of the face 10 by using a back weight 20 of height dimension less than that of the face 10 so that the shaft mounting rod 18 when assembled into the back weight 20 on an axial line through the center of the face 10 will actually be above the horizontal center line of the back weight 20 thus assuring a lower mass distribution. Also, the left connecting rod 14 and the right connecting rod 16 are attached to the face 10 and the back weight 20 below the horizontal center lines of each further assuring a low mass distribution in order to maximize the pendulum effect for the putter stroke. The left connecting rod 14 and the right connecting rod 16 are attached to the face 10 and the back weight 20 equal distances above the bottom of each assuring a repetitive soleing levelness. And, the geometric shape of the back weight 20 gives an increased surface area of that of a smaller plate type element such that repetitive soleing is further improved.

From the description above, a number of advantages of the present invention become evident:

a) face 10 and connecting rods 14, 16 are rectilinear in shape and the front edge of back weight 20 is straight so the combination provides a clean uncluttered view with distinct borders to aid in achieving perpendicular and parallel squaring to improve alignment and stroke.

b) connecting rods 14, 16 spaced the width of the golf ball aid in getting the correct ball position at address setup.

c) connecting rods 14, 16 are hollow to minimize weight and allow it to be concentrated in the back weight for maximum peripheral weight effect to mazimize moment of inertia to reduce twisting effects (torque).

d) connecting rods 14, 16 and shaft mounting rod 18 are rectilinear in plan view and contrast in color with the face 10 to create emobodied sight lines which directly improve alignment and stroke.

e) shaft mounting rod 18 by being mounted only in the back weight 20 allows a gap to be formed behind the face 10 that is an important additional embodied sight area. The gap allows for the full visualization of the "pool cue" effect of the parallel alignment provided by the shaft mounting rod 18 as it points directly through the face 10 and golf ball 40 towards the intended target line.

f) locating shaft mounting rod 18 above the plane of connecting rods 14, 16 widens and separates the embodied sight lines for improved alignment.

g) locating the back weight 20 as far behind the face 10 as allowed by the United States Golf Association (USGA) allows for maximization of the putter head's moment of inertia.

h) The rearward location of the back weight 20 places approximately 75% of the weight of the putter head behind the face 10 such that the putter head is tail heavy. This promotes a slightly rising stroke to contact the golf ball such that backspin is reduced or eliminated thereby improving the roll and distance control performance of the putter.

i) The upward location of the shaft mounting rod 18 in the back weight 20 places approximately 60% of the weight of the putter head below the centerline of the face 10, thus improving the pendulum effect for a more smooth and consistent stroke.

j) removable screws 24, 26 allow the face 10, connecting rods 14, 16, shaft mounting rod 18 and back weight 20 to be interchanged with other similar items or adjusted for desired angles which will allow full customization of the unit.

OPERATION—PREFERRED EMBODIMENT—FIGS. 1, 2, 3, 4

The manner of using the present invention is in a fully assembled golf putter with a shaft and grip attached. The golfer takes his/her basic putting setup posture and then aims the putter by framing the golf ball 40 in the center of the face 10 between the left and right connecting rods 14, 16. Then the golfer uses the face 10, connecting rods 14, 16 and shaft mounting rod 18 to establish the face 10 perpendicular to the intended starting line of the putt. The manner of using the putter head to strike a ball is the same as with other putters.

By observing movement of the face 10 and left and right connecting rods 14, 16 during practice strokes and strokes using a ball, the golfer can tell his/her amount of departure from the desired putter head path during the stroke. Self practice, proper instruction and/or reading instruction materials will tell the golfer what movements are good and what movements need to be corrected. This will enable the golfer to learn using cause and effect visual feedback and repetition of swing motion.

The manner of customizing the putter head depends on the desired effect. Right hand or left hand setup and lie angle are adjusted by loosing the shaft mounting rod screw 26, rotating the shaft mounting rod 18 and then retightening the screw 26. Lock washer 28 locks the shaft angle in place. Overall weight and peripheral weighting is adjusted by using connecting rods 14, 16 and back weight 20 elements of different weights. And, by adding discs of a higher density material than the face 10 to the heel and toe areas of the face 10. Alignment aides are adjusted by interchanging rods 14, 16, 18 that have different widths, lengths, shapes, and contrast. Appearance is changed by interchanging face 10, connecting rods 14, 16, shaft mounting rod 18 or back weight 20 that have different shapes or colors. Percussion or feel is adjusted by interchanging face 10 for another which has a different material composition or uses inserts to change percussion (impact vibrations). Finally, loft is adjusted by interchanging face 10 for another which has a different face angle or side view convexity or by using a tapered element in the connecting rod holes 30 in the back of face 10.

CONCLUSIONS, RAMIFICATIONS AND SCOPE

Previous attempts for providing multiple perpendicular and parallel squaring elements have suffered from an ostensibly inverse relationship between peripheral weighting and parallel squaring. When peripheral weighting was improved, parallel squaring was weakened, and vice versa. The present putter head design optimizes both peripheral weighting and parallel squaring by significantly increasing the density of the peripheral elements, maintaining logical spacing of parallel peripheral elements, controlling the length of the center element to produce a gap as an additional embodied sight area for optimum alignment.

The color contrast between the connecting rods and the putter face promotes maximum visual awareness of the ball position and face alignment to the desired starting path. The rearward location of the mounted putter shaft allows a clear framed view of the ball, the putter face and the connecting rods for optimum alignment assistance. The elimination of other alignment aids such as balls, discs, lines and closely spaced rails, rods or bars provides for an uncluttered and non-confilicting alignment view that consists solely of perpendicular and parallel rectilinear objects.

The present putter head design also optimizes rearward and downward weight distribution to reduce twisting and improve pendulum stroke and consistent roll.

The present invention is useful as an initial learning apparatus, a practice apparatus for continuing improvement and a playing apparatus.

The present putter head design also facilitates considerable customization. Unlike putter heads in the past where only a few attributes could be changed in one unit, the present putter head design facilitates the customization of right or left hadn, lie, peripheral weighting, total weight, alignment aides, torque (moment of inertia), appearance, percussion (feel) and loft.

Though the present putter head design provides considerable customization, it may be necessary to limit the extent of such customization so as abide by the rules of the United States Golf Association (USGA). Examples of such rules are: the putter head must be longer from heel to toe than front to back, length from heel to toe can not exceed seven inches, the loft can not exceed 10 degrees, the putter head must be plain in shape, the shaft angle must exceed ten degrees from vertical; etc. . . . . By providing a few interchangeable pieces and simple adjustments, the putter head will prevent illegal combinations. Certain attributes could be deemed surperior, thus eliminating the need for variations, or the rules could change, requiring addtional variations.

Although, the description above contains much specificity, these should not be construed as limiting the scope of the invention but as merely providing an illustration of the presently preferred embodiment of this invention. For example, the back weight assembly does not have to be half-moon shaped but could be rectangular, tubular, triangular or other shapes that could still be high mass and have the shaft mounting rod and left and right connecting rods attached. The connecting rods and shaft mounting rod do not have to be circular in shape they could be rectangular, triangular, hexagonal, etc. Even though our testing has shown that circular rods give the best visual alignment assistance and the most flexibility in allowing adjustment of shaft lie angle. The putter face can be any that facilitates attachment of the connecting rods. The putter head design of the present invention can be used on putters for right or left hand swinging golfers of any age, gender or degree of golf experience. Other assembly methods such as epoxy, set screws, or pins could be used in conjunction with screws or in place of them. Molding, casting or other fabrication methods could produce parts with the same function but grouped as a more complete unit with fewer oveall parts. Materials can be aluminum, steel, tungsten, brass, bronze ceramic, wood or plastic to name a few. Thus the scope of the invention should be determined by the appended claims and their legal equivalents, and not by the examples given.

I claim:

1. A golf putter head comprising:

at least two distinct elongated connecting rods of predetermined thickness, shape and length, said rods extending parallel to each other;

at least one elongated plate of predetermined thickness, shape and length, said plate extending perpendicular to said connecting rods; and at least one back weight element of predetermined thickness, shape and length; and at least one shaft mounting rod of predetermined thickness, shape and length extending parallel to said connecting rods and perpendicular to said elongated plate and said backweight element; and at least two fastening elements fixedly coupling said connecting rods between said plate and said back weight element, said connecting rods being spaced approximately the width of a golf ball diameter whereby the gap between said connecting rods creates relational sight lines; and at least one fastening element fixedly coupling said shaft mounting rod to said back weight element, the free end of said shaft mounting rod being spaced approximately the thickness of said elongated plate from said elongated plate whereby the gap allows for an uncluttered relational sight area.

2. A golf putter head in accordance with claim 1, wherein said shaft mounting element is disposed closest to the midpoint of said extended plate.

3. A golf putter head in accordance with claim 1, wherein said connecting rod members and said shaft mounting rod are rectilinear in plan view and devoid of non-linear, plan-view interference.

4. A golf putter head in accordance with claim 1, wherein said at least two fastening elements detachably connect said plate and said back weight element and said connecting rods to allow said plate, back weight element and connecting rods to be disassembled and reassembled.

5. A golf putter head in accordance with claim 1, wherein said at least one fastening element rotatably connects said shaft mounting rod to said back weight element.

6. A golf putter head in accordance with claim 1, wherein said plate has a planar surface so as to form a striking face.

* * * * *